US006767880B1

(12) United States Patent
Foley et al.

(10) Patent No.: US 6,767,880 B1
(45) Date of Patent: Jul. 27, 2004

(54) LIQUID DISHWASHING DETERGENT COMPOSITION HAVING POLYMERIC PARTICLES

(75) Inventors: Peter Robert Foley, Cincinnati, OH (US); Brian Xiaoqing Song, West Chester, OH (US); Mary Ruth Leyendecker, Cincinnati, OH (US); Eugene Steven Sadlowski, Cincinnati, OH (US); Jeffrey Donald Painter, Loveland, OH (US); Joseph Herbert Thien, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/937,354

(22) PCT Filed: Apr. 18, 2000

(86) PCT No.: PCT/US00/10387

§ 371 (c)(1),
(2), (4) Date: Sep. 24, 2001

(87) PCT Pub. No.: WO00/63342

PCT Pub. Date: Oct. 26, 2000

Related U.S. Application Data

(60) Provisional application No. 60/130,042, filed on Apr. 19, 1999.

(51) Int. Cl.[7] ..... C11D 3/14; C11D 3/22; C11D 3/37; C11D 3/40

(52) U.S. Cl. ..... 510/419; 510/221; 510/223; 510/224; 510/227; 510/230; 510/235; 510/418; 510/434; 510/441; 510/442; 510/443; 510/452; 510/471; 134/25.2; 134/25.3; 134/42

(58) Field of Search ..... 510/221, 223, 510/224, 227, 230, 235, 418, 419, 434, 441, 442, 443, 452, 471; 134/25.2, 25.3, 42

(56) References Cited

U.S. PATENT DOCUMENTS

| | | | | | |
|---|---|---|---|---|---|
| 4,090,973 A | * | 5/1978 | Maguire, Jr. et al. | ..... | 252/89 R |
| 5,108,641 A | * | 4/1992 | Ahmed et al. | ..... | 252/94 |
| 5,164,106 A | | 11/1992 | Ahmed et al. | | |

FOREIGN PATENT DOCUMENTS

| | | | | | |
|---|---|---|---|---|---|
| DE | 2232131 | | * | 1/1973 | ..... B01F/17/00 |
| DE | 299 03 535 | U1 | | 7/1999 | |
| EP | 0 510 761 | A1 | | 10/1992 | |
| EP | WO 93/22417 | | * | 11/1993 | ..... C11D/17/00 |
| EP | 0 653 485 | A1 | | 5/1995 | |
| EP | 653485 | | * | 5/1995 | ..... C11D/17/00 |
| EP | WO 00/63342 | | * | 10/2000 | ..... C11D/17/00 |
| FR | 2.144.712 | | | 2/1973 | |
| WO | WO 93/22417 | | | 1/1993 | |

* cited by examiner

*Primary Examiner*—Brian P. Mruk
(74) *Attorney, Agent, or Firm*—Kevin L. Waugh

(57) ABSTRACT

A process for improving aesthetics of a liquid dishwashing detergent product is disclosed. The process includes the steps of providing a liquid dishwashing detergent composition and adding solid particles to the liquid dishwashing detergent composition. The particles are coated with a polymeric coating. The coating is prepared from materials which are insoluble in the liquid dishwashing detergent composition but soluble in dishwashing wash solution.

25 Claims, No Drawings

LIQUID DISHWASHING DETERGENT COMPOSITION HAVING POLYMERIC PARTICLES

This application claims the benefit of Provisional application Ser. No. 60/130,042, filed Apr. 19,1998.

TECHNICAL FIELD

The present invention relates to liquid dishwashing detergent compositions. More particularly, the invention relates to a process for improving the aesthetics of a liquid manual dishwashing detergent product, and a liquid automatic dishwashing detergent composition having solid particles disposed therein, the particles preferably being colored or whitened for improving aesthetics.

BACKGROUND OF THE INVENTION

The incorporation of detersive enzymes into dishwashing detergents is well known in the arena of both automatic dishwashing (ADW) formulas and liquid hand dishwashing formulas (LDLs). A recognized need in ADWs compositions is to have present one or more ingredients which improve the removal of tough foods and stains (e.g., tea, coffee, cocoa, etc.) from consumer articles. Strong alkalis like sodium hydroxide, bleaches such as hypochlorite, builders such as phosphates and the like can help in varying degrees. Moreover, improved ADWs make use of a source of hydrogen peroxide, optionally with a bleach activator such as TAED, as noted. In addition, enzymes such as commercial proteolytic and amylolytic enzymes can be used. The alpha-amylase component provides at least some benefit with respect to the starchy soil removal properties of the ADW. ADWs containing amylases typically can also deliver a somewhat more moderate wash pH in use, and can remove starchy soils while avoiding delivering large weight equivalents of sodium hydroxide on a per-gram-of-product basis.

Typically, the enzyme component of a liquid ADW composition is added to the ADW composition in liquid form. While this allows the liquid ADW composition to have the benefits of enzyme content discussed above, there are also disadvantages, most notably that the liquid ADW composition must be formulated at pH levels that are lower than those conventionally used because enzymes are rendered ineffectual after being exposed to high pH environments. Because formulating at lower pH levels can harm cleaning performance (high pH enhances cleaning by aiding the rates of hydration and hydrolysis), a need exists for an enzyme material that is stable in a high pH environment.

One approach to improving enzyme stability in a high pH (greater than 9) ADW detergent composition is to add the enzyme as a solid particle. This "enzyme particle" consists of a solid core enzyme material coated with a barrier layer material. For example, a solid enzyme material can be coated with a thick wax layer material to form an enzyme particle and then this enzyme particle may be added to the ADW composition.

But the use of these wax coatings have several disadvantages. Most notably, when the waxes melt and are released into the wash solution due to the high temperature encountered during the automatic dishwashing process, they tend to cause undesirable filming on glass, stainless steel and plastic surfaces. This filming is a particular problem with ADW formulas, which often contain no significant surfactants in the composition. Additionally, thick wax coatings can also reduce the rate of dissolution of the enzyme-containing particle, which may reduce the cleaning contribution of the enzyme, by reducing the time it is resident in the wash solution.

Given the foregoing there is a continuing need to develop new compositions for the enzyme particles that will protect the enzyme core material when the particle is added to a high pH liquid ADW composition and yet at the same time not produce the undesirable filming associated with wax coatings, nor inhibit the rapid dissolution of the enzyme-containing particles.

Accordingly, it is a benefit of the present invention that producing an enzyme particle with a two-layer coating effectively protects the core enzyme material from high pH liquid compositions, without the deleterious effects of the thick wax layer coating noted above. This two-layer consists of an interior chemical barrier, preferably an acidic barrier, which is itself coated with an exterior physical barrier. The physical barrier prevents the chemical barrier from reacting directly with the alkaline liquid product (particularly important when the chemical barrier is an acidic barrier), while the chemical barrier effectively neutralizes any stray hydroxyl groups of the alkaline product that permeate past the physical barrier coating. The chemical and physical barrier thus work together and provide complementary functions. Preferred physical barriers include polymeric coatings that are insoluble in the liquid automatic dishwashing detergent composition but soluble, meltable or dispersable under the pH, temperature and agitation conditions of an ADW device.

In addition to their use in ADW compositions, these improved enzyme particles may be incorporated into light-duty liquid (LDL) detergent compositions useful for manual dishwashing as well. Enzymes, typically commercial proteolytic and amylolytic enzymes, provide LDL compositions with a variety of benefits, including improved cleaning performance as well as preferred skin mildness and "skin feel" aesthetics (i.e. the product does not feel slimy or slippery in the hands of a consumer). By adding enzymes to a LDL composition in the form of an enzyme particle, stability of enzymes in a LDL composition, as in an ADW composition, can be enhanced. Release of the enzymes is accomplished easily as a result of the agitation and increased temperature during manual dishwashing by the consumer.

BACKGROUND ART

U.S. Pat. No. 5,164,106 discloses a non-aqueous liquid automatic dishwasher detergent composition containing a dual bleach system.

U.S. Pat. No. 5,108,641 discloses an aqueous liquid automatic dishwasher detergent composition containing a dual bleach system.

SUMMARY OF THE INVENTION

The invention meets the needs above by providing a process of improving aesthetics of a liquid dishwashing detergent product and a liquid dishwashing detergent product having enhanced aesthetics.

In one aspect of the present invention, the process of improving aesthetics of a liquid dishwashing detergent product includes the steps of providing a liquid dishwashing detergent composition and adding solid particles to the liquid dishwashing detergent composition. The particles are coated with a polymeric coating. The coating is prepared from materials which are insoluble in the liquid detergent composition but soluble in dishwashing wash solution.

In another aspect of the present invention, the liquid dishwashing detergent product having enhanced aesthetics includes a liquid dishwashing composition and solid particles. The particles are coated with a polymeric coating. The coating is prepared from materials selected from the group consisting of alkyl cellulose ethers, polyvinyl alcohol and alginate. The particles remain undissolved in said liquid dishwashing detergent composition until the composition is used either in an automatic dishwasher, or as a hand dishwashing product. The liquid dishwashing detergent product does not cause a significant increase in filming of glassware or dishware as compared to a liquid dishwashing detergent product not having the above particles, and furthermore, the liquid automatic dishwashing detergent product does not cause a significant increase in filming of glassware or dishware even in liquid compositions that do not contain any surfactants. Furthermore, the product does not leave significantly increased amounts of residue derived from the solid particles.

DETAILED DESCRIPTION OF THE INVENTION

Definitions—By "liquid dishwashing detergent composition" or "liquid dishwashing detergent product" it is meant a detergent composition that is employed in manual (i.e. hand) or automatic dishwashing.

In the preferred embodiment of the present invention, the process of improving aesthetics of a liquid dishwashing detergent product includes the steps of providing a liquid dishwashing detergent composition and adding solid particles to the liquid dishwashing detergent composition.

Particles

In the preferred embodiment, the particles are coated with a polymeric coating which is insoluble in the liquid automatic dishwashing detergent composition but soluble in automatic dishwashing wash solution. The coating is prepared from materials which are insoluble in the liquid dishwashing detergent composition but soluble in dishwashing solution. The coating is prepared from materials selected from the group consisting of alkyl cellulose ethers and polyvinyl alcohol. Alternatively, the coating is prepared from alginate. Desirably, the alkyl cellulose ethers are methyl cellulose and hydroxypropyl methyl cellulose (HPMC). Preferably, the coating is prepared from methyl cellulose having a number average molecular weight desirably in a range of from about 5000 to about 100,000, more preferably from about 10,000 to about 20,000, and most preferably, about 14,000. The preferred methyl cellulose is one sold under the trade name Methocel A15LV, and manufactured by Dow Chemicals. Alternatively, the polymeric coating is polyvinyl alcohol (PVA) having a molecular weight, desirably in a range of from about 5000 to about 100,000, and preferably from about 13,000 to about 23,000. The preferred PVA is from about 87% to about 89% hydrolyzed, such as a commercially available product having a trade name Airvol 205. Further, the particles are insoluble in the liquid dishwashing detergent composition and only soluble in the wash solution during dishwashing.

Process for Forming Polymeric Coating on Particles

The process by which the polymeric coating is prepared and deposited upon the particle is critical in order for the particles to remain undissolved in the liquid dishwashing detergent composition and only become soluble in the wash solution during the dishwashing process. It is desirable that the particles dispersed in the liquid ADW compositions do not break up or dissolve in the composition. It is also desirable that this be achieved without depositing an unduly thick coating of a polymeric material on the particle. It has been surprisingly discovered that when the polymeric material, such as methyl cellulose is sufficiently hydrated before spraying on the particle or prill, the polymer coated particle or prill remains stable, unbroken and undissolved in the liquid ADW composition. This hydration is achieved by forming a sprayable aqueous solution of the polymer (alkyl cellulose ether and/or polyvinyl alcohol) having a polymer concentration desirably in a range of from about 1% to about 30% by weight, preferably in a range of about 3% to about 20%, more preferably in a range of about 3% to about 10%, and most preferably, about 5%. Further, the temperature of aqueous solution of the polymer is desirably maintained within a range of from about 30° C. to about 40° C. while spraying the polymer solution on the particle, and preferably in a range of from about 32° C. to about 38° C., and most preferably at a temperature of about 35° C. It has been surprisingly found that by using a combination of the above process steps, i.e., the polymer solution being in a range of from about 1% to 30% by weight, and the spray temperature being in a range of from about 30° C. to about 40° C., that a very stable, unbroken, continuous coating is formed on the particle or prill which is undissolved in the liquid composition but soluble in the wash solution, while at the same time, requiring only about 5% polymer by weight of the particle. This offers an advantage because by using a smaller the quantity of polymer used for coating the aesthetic prill or particle, there is a reduction in the amount of polymer residue that can potentially redeposit on the dishware when the particle dissolves in the wash solution.

Preferably, the particles are colored or whitened. In one embodiment, the particles are colored and the dishwashing liquid detergent composition is clear or translucent, so as to make the liquid dishwashing product aesthetically pleasing. In another embodiment, the particles and the liquid dishwashing detergent composition are both colored and the color of the particles is matched to the base color of the liquid composition. In one embodiment, the particles have a dark green color whereas the liquid composition has a light green color. Other preferred color combinations for the polymeric coating on the particles and the liquid dishwashing composition are: blue:blue, blue:white, green:green, green:white and green:yellow, respectively. Desirably, the particles comprise from about 0.1% to about 5.0% by weight of the liquid composition, and preferably, from about 0.2% to about 1.0% by weight of the liquid composition. The particles can be formed from various materials that do not cause any detrimental affect upon the performance of the liquid detergent. Preferably, the particles are in the form of prills. The prills typically have a core which is coated with a polymeric coating as described before. The core can be made from sucrose, as an example. The method of forming prills is well known to those skilled in the art and is disclosed in the literature, such as for example, in U.S. Pat. No. 4,965,012, which is incorporated herein by reference.

The particles can be of various sizes and shapes, such as spherical, oval, cylindrical or polygonal and desirably have a particle size in a range of from about 200 $\mu$m to about 5000 $\mu$m, preferably, from about 400 $\mu$m to about 2000 $\mu$m, and most preferably, from about 500 $\mu$m to about 850 $\mu$m.

In the preferred embodiment, the liquid dishwashing detergent product having enhanced aesthetics comprises a liquid dishwashing composition having solid particles wherein the particles are coated with a polymeric coating and the coating is prepared from materials selected from the group consisting of alkyl cellulose ethers, polyvinyl alcohol and alginate. Preferably, the particles are adapted to remain undissolved in the liquid automatic dishwashing detergent composition until the composition is used in an automatic dishwasher. Further, the liquid automatic dishwashing detergent product desirably does not cause an increase in filming of glassware or dishware, as compared to a liquid automatic detergent product not having the above particles.

In the preferred embodiment of the liquid dishwashing detergent product, the polymeric coating is water-soluble and preferably, the polymeric coating is formed from methyl cellulose.

In one preferred embodiment, the liquid dishwashing detergent product is highly viscous in a quiescent state and has a relatively high yield stress values. When subjected to shear stresses, however, such as being shaken in a container or squeezed through an orifice, the product quickly fluidizes and upon cessation of the applied shear stress, quickly reverts to a high viscosity state. The above liquid can be an automatic dishwashing detergent product, and as such is preferably low foaming, readily soluble in the washing medium and most effective at pH values best conducive to improved cleaning in a dishwasher, such as in a range of desirably from about pH 7.0 to about pH 13.0, and preferably from about pH 8.0 to about pH 12.0, more preferably from about pH 8.5 to about pH 11.5. Alternatively, the liquid can be for use as a hand dishwashing product, and as such, is preferably high foaming.

The physical stability of the liquid product may be improved and the thickness of the liquid product may be altered by the addition of a cross linking polyacrylate thickener to the liquid detergent product as a thixotropic thickener.

PH Adjusting Components

The pH adjusting components are desirably selected from sodium or potassium carbonate or sesquicarbonate, sodium or potassium silicate, citric acid, sodium or potassium bicarbonate, sodium or potassium borate, sodium or potassium hydroxide, and mixtures thereof. NaOH or KOH are the preferred ingredients for increasing the pH to within the above ranges. Other preferred pH adjusting ingredients are sodium carbonate, potassium carbonate, and mixtures thereof.

Surfactant

The liquid nonionic surfactant detergents that can be used to practice the present invention for automatic dishwashing formulas are preferably alkyl ethoxylates in non-chlorine bleach liquid automatic dishwashing compositions and, chlorine bleach stable low foaming surfactants in chlorine bleach containing liquid automatic dishwashing compositions. Surfactant concentrations are typically in range of from about 0.1% to about 10% by weight of the liquid composition. Chlorine bleach stable low foaming surfactants are generally known to one skilled in the art and need not be elaborated here, for purposes of brevity. One example of such a surfactant is an anionic surfactant commercially available under the trade name Dowfax.

The detergent surfactants used high foaming compositions include polyhydroxy fatty acid amides; nonionic fatty alkypolyglucosides; $C_{8-22}$ alkyl sulfates; $C_{9-15}$ alkyl benzene sulfonates, $C_{8-22}$ alkyl ether sulfates; $C_{8-22}$ olefin sulfonates; $C_{8-22}$ paraffin sulfonates; $C_{8-22}$ alkyl glyceryl ether sulfonates; fatty acid ester sulfonates; secondary alcohol sulfates; $C_{12-16}$ alkyl ethoxy carboxylates; $C_{11-16}$ secondary soaps; ampholytic detergent surfactants; and zwitterionic detergent surfactants. Mixtures of these detergent surfactants are also contemplated.

The cations associated with these anionic surfactants are preferably selected from the group consisting of calcium, sodium, potassium, magnesium, ammonium or alkanolammonium, and mixtures thereof, preferably sodium, ammonium, calcium and magnesium and/or mixtures thereof.

2) Hydrotropes

A component which can be important for both stability of liquid formulations, and can also enhance the skin feel/rinsability of hand dishwashing formulas is the hydrotrope. Hydrotropes suitable for use these compositions include the $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these hydrotrope materials. Suitable $C_1$–$C_3$ alkyl aryl sulfonates are preferably $C_7$–$C_9$ alkyl aryl sulfonates and include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof. Other compounds which deliver hydrotropic effects suitable for use herein as a hydrotrope include $C_6$–$C_{12}$ alkanols and urea. Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof. These preferred hydrotrope materials will be present in the composition to the extent of from about 2% to 7% by weight Protease Enzyme The compositions of this invention will generally contain from about 0.001% to about 5%, more preferably from about 0.003% to about 4%, most preferably from about 0.005% to about 3%, by weight, of active protease, i.e., proteolytic, enzyme. Protease activity may be expressed in Anson units (AU.) per kilogram of detergent composition. Levels of from 0.01 to about 150, preferably from about 0.05 to about 80, most preferably from about 0.1 to about 40 AU. per kilogram have been found to be acceptable in compositions of the present invention.

The proteolytic enzyme can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase® Savinase® (Copenhagen, Denmark), Gist-brocades' Maxatase®, Maxacal® and Maxapem 15® (protein engineered Maxacal®) (Delft, Netherlands), and subtilisin BPN and BPN'(preferred), which are commercially available. Preferred proteolytic enzymes are also modified bacterial serine proteases, such as those made by Genencor International, Inc. (San Francisco, Calif.) which are described in European Patent EP-B-251, 446, granted Dec. 28, 1994 and published Jan. 7, 1988 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Preferred proteolytic enzymes, then, are selected from the group consisting of Alcalase® (Novo Industri A/S), BPN', Protease A and Protease B (Genencor), and mixtures thereof. Protease B is most preferred.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliqiefaciens* subtilisin, as described in WO 95/10615 published Apr. 20, 1995 by Genencor International.

Useful proteases are also described in PCT publications: WO 95130010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Protease enzymes can provide a skin care benefit in the context of the dishwashing detergent products and methods herein. It is believed that the protease functions primarily by providing a desquamatory action to the detergent composition. It is believed that the proteases remove damaged (e.g. dry) skin cells on the surface of the skin, thereby reducing the rough feel associated therewith. The protease removes the effect of prior damage to the skin, giving the skin a fresher, more youthful appearance and feel. When the protease is combined with a detergent surfactant and the skin feel/rinsability enhancing system, the overall effect is to promote the health of the skin and to provide the consumer with a perceived mildness or skin feel/appearance advantage over other similar detergent compositions which do not contain protease while still maintaining good cleaning performance.

Buffers

The Formula may Also Contain Buffers to Maintain Either Product or Wash at a Preferred pH.

Preferred buffering agents for hand dishwashing compositions are nitrogen-containing materials.

Some examples are amino acids or lower alcohol amines like mono-, di-, and tri-ethanolamine. Other preferred nitrogen-containing buffering agents are 2-amino-2-ethyl-1, 3-propanediol, 2-amino-2-methyl- propanol, 2-amino-2-methyl-1,3-propanediol, tris-(hydroxy-methyl) aminomethane (a.k.a. tris) and disodium glutamate. N-methyl diethanolamine, 1,3-diamino-2-propanol N,N'-tetramethyl-1,3-diamino-2-propanol, N,N-bis(2-hydroxyethyl)glycine (a.k.a. bicine), and N-tris (hydroxymethyl)methyl glycine (a.k.a. tricine) are also preferred. Mixtures of any of the above are acceptable. Automatic dishwashing formulas often use inorganic buffers, such as carbonate, silicate or phosphate. However, it is possible for both automatic and hand dishwashing formulas to use both organic and inorganic buffers, either in combination or in isolation.

Other Ingredients

The liquid dishwashing detergent composition optionally also contains from about 0.5% to about 20% of a dispersant polymer selected from the group consisting of polyacrylates and polyacrylate copolymers, and a stabilizing system for the protease enzyme. Automatic dishwashing formulas can also contain from about 0.1% to about 5% of a chlorine bleach stable foam suppressant. Such foam suppressants are well known to those skilled in the art.

Preferred optional ingredients for hand dishwashing compositions herein include suds boosters/stabilizers, and calcium and/or other inorganic ions. These and other optional ingredients are described as follows:

a) Suds Boosters

The compositions herein will preferably include from about 1% to 20%, preferably from about 2% to 15%, of suds boosters such as betaines, certain relatively long-chain alcoholethylene oxide condensates, fatty acid amides, amine oxide semi-polar nonionics, sultaines, complex betaines and cationic surfactants.

The compositions of this invention can contain betaine detergent surfactants having the general formula:

$$R-\overset{(+)}{N}(R^1)_2-R^2\overset{(-)}{CO_2}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido 1 or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e,g., they can be derived from naturally occurring fatty acids; olefins such as those prepared by Ziegler, or Oxo processes; or from olefins separated from petroleum either with or without "cracking".

The alcohol/ethylene oxide condensate suds boosters are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of relatively long-chain aliphatic alcohols with ethylene oxide. The alkyl chain of the aliphatic alcohol can either be straight or branched and generally contains from about 14 to about 18, preferably from about 14 to about 16, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful as suds boosters herein include the ammonia, monoethanol, and diethanol amides of fatty acids having an acyl moiety containing from about 8 to about 18 carbon atoms and represented by the general formula:

$$R^1-CO-N(H)_{m-1}(R_2OH)_{3-m}$$

wherein $R^1$ is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanol amine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula:

$$R_1(C_2H_4O)_nN^+R_2R_3—O^-$$

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

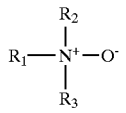

wherein $R^1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference.

The sultaines useful as suds boosters in the present invention are those compounds having the formula $R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12-14}$ amido propyl ammonio-2-hydroxypropyl sultaine, $C_{12-14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

The complex betaines for use as suds boosters herein have the formula:

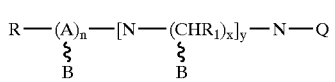

(I)

wherein R is a hydrocarbon group having from 7 to 22 carbon atoms, A is the group (C(O), n is 0 or 1, $R^1$ is hydrogen or a lower alkyl group, x is 2 or 3, y is an integer of 0 to 4, Q is the group —$R_2$COOM wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

The composition of this invention can also contain certain cationic quaternary ammonium surfactants of the formula:

$$[R^1(OR^2)_y][R^3(OR^2)_y]_2R^4N^+X^-$$

or amine surfactants of the formula:

$$[R^1(OR^2)_y][R^3(OR^2)_y]R^4N$$

wherein $R^1$ is an alkyl or alkyl benzyl group having from about 6 to about 16 carbon atoms in the alkyl chain; each $R^2$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methylsulfate $C_{8-16}$ alkyl trimethylammonium salts, $C_{8-16}$ alkyl di(hydroxyethyl)methylammonium salts, the $C_{8-16}$ alkyl hydroxyethyldimethylammonium salts, $C_{8-16}$ alkyloxypropyl trimethylammonium salts, and the $C_{8-16}$ alkyloxypropyl dihydroxyethylmethylammonium salts. Of the above, the $C_{10-14}$ alkyl trimethylammonium salts are preferred, e.g., decyl trimethylammonium methylsulfate, lauryl trimethylammonium chloride, myristyl trimethylammonium bromide and coconut trimethylammonium chloride, and methylsulfate.

The suds boosters used in the compositions of this invention can contain any one or mixture of the suds boosters listed above.

b) Enzyme Stabilizing System

=The preferred compositions herein may additionally comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the protease enzyme of the present invention. Such stabilizing systems can comprise calcium ion, boric acid, propylene glycol, short chain carboxylic acid, boronic acid, polyhydroxyl compounds and mixtures thereof such as are described in U.S. Pat. Nos. 4,261,868, Hora et al, issued Apr. 14, 1981; 4,404,115, Tai, issued Sep. 13, 1983; 4,318,818, Letton et al; 4,243,543, Guildert et al issued Jan. 6, 1981; 4,462,922, Boskamp, issued Jul. 31, 1984; 4,532,064, Boskamp, issued Jul. 30, 1985; and 4,537,707, Severson Jr., issued Aug. 27, 1985, all of which are incorporated herein by reference.

Additionally, from 0 to about 10%, preferably from about 0.01% to about 6% by weight, of chlorine bleach scavengers can be added to compositions of the present invention to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbarnate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, percarbonate, phosphate, condensed phosphate, acetate, benzoate, citrate, formate, lactate, malate, tatrate, salicylate, etc. and mixtures thereof can also be used. The preferred ammonium salts or other salts of the specific chlorine scavenger anions can either replace the suds controlling agent or be added in addition to the suds controlling agent.

Although ammonium salts can be admixed with the detergent composition, they are prone to adsorb water and/or give off ammonia gas. Accordingly, it is better if they are protected in a particle like that described in U.S. Pat. No. 4,652,392, Baginski et al, which is incorporated herein by reference.

Other conventional optional ingredients which are usually used in additive levels of below about 5% include opacifiers, antioxidants, bactericides, dyes, perfumes, and the like.

Detergency builders can also be present in amounts from 0% to about 50%, preferably from about 2% to about 30%, most preferably from about 5% to about 15%. The compositions of this invention may contain for chelating and detergency purposes from about 0.001% to about 15% of certain alkylpolyethoxypolycarboxlyate surfactants of the general formula

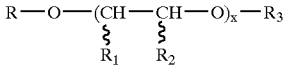

wherein R is a $C_6$ to $C_{18}$ alkyl group, x ranges from about 1 to about 24, $R^1$ and $R_2$ are selected from the group consisting of hydrogen, methyl acid radical succinic acid radical hydroxy succinic acid radical, and mixtures thereof, wherein at least one $R^1$ or $R_2$ is a succinic acid and/or hydroxysuccinic acid radical. An example of a commercially available alkylpolyethoxypoly-carboxylate which can be employed in the present invention is POLY-TERGENT C, Olin Corporation, Cheshire, Conn.

The alkylpolyethoxypolycarboxylate surfactant is selected on the basis of its degree of hydrophilicity. A balance of carboxylation and ethoxylation is required in the alkylpolycthoxypolycarboxylate in order to achieve maximum chelating benefits without affecting the cleaning benefits which is associated with the divalent ions or the sudsing of the liquid or gel dishwashing detergent compositions. The number of carboxylate groups dictates the chelating ability, too much carboxylation will result in too strong a chelator and prevent cleaning by the divalent ions. A high degree of ethoxylation is desired for mildness and solubility; however, too high a level will affect sudsing. Therefore, an alkylpolyethoxypolycarboxylate with a modest degree of ethoxylation and minimal carboxylation is desirable.

Other desirable ingredients include diluents and solvents. Diluents can be inorganic salts, such as sodium sulfate, sodium chloride, sodium bicarbonate, etc., and the solvents include water, lower molecular weight alcohols such as ethyl alcohol, isopropyl alcohol, etc. In liquid detergent compositions there will typically be from 0% to about 90%, preferably from about 20% to about 70%, most preferably from about 40% to about 60% of water, and from 0% to about 50%, most preferably from about 3% to about 10% of ingredients to promote solubility, including ethyl or isopropyl alcohol, etc.

To exemplify various embodiments of the present invention, Samples A, B, C, D, and E of the liquid automatic dishwashing detergent product compositions were formulated using the below named ingredients, as set forth in Example A. Samples F, G and H are examples of hand dishwashing formulas, and are set out in Example B.

EXAMPLE A

| Ingredient (weight % active) | A | B | C | D | E |
|---|---|---|---|---|---|
| Sodium Tripolyphosphate | 17.5 | 16.0 | — | 8.0 | 16.0 |
| Potassium Tripolyphosphate | — | — | 16.0 | 8.0 | 16.0 |
| Sodium Silicate | 6.0 | 1.0 | — | — | — |
| Potassium hydroxide | 3.6 | 5.6 | 5.6 | 1.0 | 1.0 |
| Sodium hydroxide | 2.0 | 2.0 | 2.0 | — | — |
| Polyacrylate polymer | 1.0 | — | — | — | — |
| Nitric Acid | 0.012 | — | — | — | — |
| Perfume | 0.03 | 0.05 | 0.05 | 0.03 | 0.04 |
| Nonionic surfactant | — | 0.5 | 0.8 | 0.7 | 1.5 |
| Sodium Benzoate | 0.75 | — | — | — | — |
| Sodium hypochlorite | 1.15 | — | — | — | — |
| Polyacrylate polymer thickener | 1.5 | 1.5 | 1.5 | 1.5 | 1.0 |
| Dye solution | — | — | 0.001 | 0.001 | 0.0005 |
| Solid Prill | 0.5 | 0.5 | 0.5 | 0.5 | 0.7 |
| Water | Bal. | Bal. | Bal. | Bal. | Bal. |
| TOTAL | 100.0 | 100.0 | 100.0 | 100.0 | 100.0 |

In the above compositions, the solid particles having a spherical shape, and a diameter of about 750 $\mu$m, are formed from a sucrose core coated with a polymeric coating formed from methyl cellulose (Methocel A15LV), and having a bluish-green color. The bluish-green color is imparted by adding a dye or pigment into the methyl cellulose coating before spraying it on the particle. The particles comprise about 0.1% to about 5% by weight of the liquid composition. The optimum methyl cellulose coating is about 5% by weight of the particle. The coating is sprayed on the sucrose core particle by spraying a 5% by weight aqueous solution of methyl cellulose on the prill, the aqueous solution temperature being carefully maintained at about 35° C. The resultant particles are insoluble in the liquid composition but are soluble in the wash solution during automatic dishwashing.

Accordingly, having thus described the invention in detail, it will be obvious to those skilled in the art that various changes may be made without departing from the scope of the invention and the invention is not to be considered limited to what is described in the specification.

EXAMPLE B

| Ingredient | Composition F | G | H |
|---|---|---|---|
| | % Weight | | |
| Ammonium $C_{12-13}$ alkyl ethoxy$_{(1)}$ sulfate | 28.0 | 27.0 | 28.5 |
| Coconut amine oxide | 4.6 | 6.1 | 2.6 |
| Alcohol Ethoxylate $C_8E_{11}$ | 5.0 | 0.0 | 5.0 |

-continued

EXAMPLE B

| Ingredient | Composition F | G % Weight | H |
|---|---|---|---|
| Ammonium xylene sulfonate | 0.0 | 4.0 | 4.0 |
| Ethanol | 4.0 | 4.0 | 4.0 |
| Magnesium chloride | 3.3 | 3.3 | 3.3 |
| Prills | 1.0 | 0.5 | 1.0 |
| Thixcin | 0.5 | 0.1 | 0.0 |
| Water and minors | | Balance | |

What is claimed is:

1. A process of improving aesthetics of a liquid dishwashing detergent product, comprising the steps of:

a) providing a liquid dishwashing detergent composition; and b) adding solid particles to the liquid dishwashing detergent composition, wherein the particles comprise a hydrated polymeric coating formed from a sprayable aqueous solution comprising from about 1% to about 30% by weight of a polymeric material, wherein the polymeric coating is insoluble in the liquid dishwashing detergent composition but soluble in dishwashing solution and wherein the polymeric coating and the liquid automatic dishwashing composition comprise observed color with or without whitening selected from the group consisting of blue, blue-green, green, yellow, white, and combinations thereof.

2. The process according to claim 1, wherein the polymeric coating comprises about 5% by weight of the particle.

3. The process according to claim 1, wherein the polymeric material comprises alkyl cellulose ether, polyvinyl alcohol, or mixtures thereof.

4. The process according to claim 3, wherein the polymeric material comprises methyl cellulose.

5. The process according to claim 4, wherein the methyl cellulose has a molecular weight in a range of from about 5,000 to about 100,000.

6. A process of improving aesthetics of a liquid dishwashing detergent product, comprising the steps of:

a) providing a liquid dishwashing detergent composition; and b) adding solid particles to the liquid dishwashing detergent composition, wherein the particles are coated with a polymeric coating which is insoluble in the liquid dishwashing detergent composition but soluble in dishwashing solution, wherein the polymeric coating comprises alginate.

7. The process according to claim 1, wherein the particles are present in the liquid dishwashing detergent composition in an amount in a range of from about 0.1% to about 5.0% by weight of the liquid dishwashing detergent product.

8. The process according to claim 7, wherein the particles are present in the liquid dishwashing detergent composition in an amount in a range of from about 0.2% to about 1.0% by weight of the liquid dishwashing detergent product.

9. The process according to claim 1, wherein the polymeric material comprises from about 3% to about 20% by weight of the sprayable aqueous solution.

10. The process according to claim 1, wherein the polymeric material comprises from about 3% to about 10% by weight of the sprayable aqueous solution.

11. The process according to claim 1, wherein the sprayable aqueous solution is at a temperature from about 30° C. to about 40° C.

12. A liquid dishwashing detergent product having enhanced aesthetics, comprising:

a) a liquid dishwashing detergent composition; and b) solid particles, wherein the particles comprise a hydrated polymeric coating formed from a sprayable aqueous solution comprising from about 1% to about 30% by weight of a polymeric material, wherein the material is selected from the group consisting of alkyl cellulose ethers, polyvinyl alcohol, alginate and mixtures thereof, and wherein the particles are adapted to remain undissolved in the liquid dishwashing detergent composition until the composition is adapted for manual or automatic dishwashing and wherein the polymeric coating and the liquid automatic dishwashing composition comprise observed color with or without whitening selected from the group consisting of blue, blue-green, green, yellow, white, and combinations thereof.

13. The liquid dishwashing detergent product according to claim 12, wherein the polymeric coating comprises about 5% by weight of the particle.

14. The liquid dishwashing detergent product according to claim 12, wherein the polymeric material comprises methyl cellulose having a molecular weight in a range of from about 5,000 to about 100,000.

15. The liquid dishwashing detergent product according to claim 12, further comprising one or more of an enzyme, a nonionic low foaming surfactant, a dispersant polymer, an alkalinity forming agent, a phosphate builder, a bleaching species, and a pH adjusting component.

16. The liquid dishwashing detergent product according to claim 12, wherein the detergent product delivers a wash solution pH in a range of from about 8.0 to about 12.0.

17. The liquid dishwashing detergent product according to claim 12, further comprising a dispersant polymer selected from the group consisting of polyacrylates and polyacrylate copolymers in an amount of from about 0.5% to about 20% by weight of the detergent product.

18. The process according to claim 1, wherein the polymeric material comprises about 5% by weight of the sprayable aqueous solution.

19. The process according to claim 1, wherein the particles further comprise a sucrose core.

20. A liquid dishwashing detergent product, comprising:

a) a liquid detergent composition; and b) particles insoluble in the liquid detergent composition, wherein the particles comprise a hydrated polymeric coating formed from a sprayable aqueous solution comprising from about 1% to about 30% by weight of a polymeric material, and wherein the polymeric coating and the liquid automatic dishwashing composition comprise observed color with or without whitening selected from the group consisting of blue, blue-green, green, yellow, white, and combinations thereof.

21. The liquid dishwashing detergent product according to claim 20, wherein the polymeric coating comprises about 5% by weight of the particle.

22. The liquid dishwashing detergent product according to claim 20, wherein the polymeric material comprises alkyl cellulose ether, polyvinyl alcohol, alginate or a mixture thereof.

23. A process of improving aesthetics of a liquid dishwashing detergent product, comprising the steps of:

a) providing a liquid dishwashing detergent composition; and b) adding solid particles to the liquid dishwashing detergent composition, wherein the particles comprise a hydrated polymeric coating formed from a sprayable aqueous solution comprising from about 3% to about 10% by weight of a polymeric material, wherein the polymeric coating is insoluble in the liquid dishwashing detergent composition but soluble in dishwashing solution, wherein the polymeric material comprises alkyl cellulose ether, polyvinyl alcohol, alginate or a mixture thereof, and wherein the polymeric coating and the liquid automatic dishwashing composition comprise observed color with or without whitening selected from the group consisting of blue, blue-green, green, yellow, white, and combinations thereof.

24. The process according to claim 23, wherein the particles further comprises a sucrose core.

25. The liquid dishwashing detergent product according to claim 12, wherein the polymeric coating and the liquid automatic dishwashing composition comprise observed color combinations of blue:blue, blue:white, green:green, green :white, or green:yellow.

* * * * *